US007422007B1

(12) United States Patent
Gray

(10) Patent No.: US 7,422,007 B1
(45) Date of Patent: Sep. 9, 2008

(54) METHOD AND DEVICE FOR SIMULATING PITCHING

(76) Inventor: Robert Gray, 6910 Co. Rd. 249, Victory, OH (US) 43464

( * ) Notice: Subject to any disclaimer, the term of this patent is extended or adjusted under 35 U.S.C. 154(b) by 0 days.

(21) Appl. No.: 11/355,384

(22) Filed: Feb. 16, 2006

(51) Int. Cl.
*F41B 4/00* (2006.01)

(52) U.S. Cl. ..... 124/6

(58) Field of Classification Search ..... 124/6, 124/78

See application file for complete search history.

(56) References Cited

U.S. PATENT DOCUMENTS 1,211,738 A * 1/1917 Marty ..... 124/6
4,583,514 A * 4/1986 Nozato ..... 124/78
5,826,568 A * 10/1998 Van Ross, Jr. ..... 124/6
6,089,217 A * 7/2000 Paulson et al. ..... 124/78
6,164,271 A * 12/2000 Paulson et al. ..... 124/78
2002/0134367 A1 * 9/2002 Delso ..... 124/82

* cited by examiner

*Primary Examiner*—John Ricci
(74) *Attorney, Agent, or Firm*—Jerry Semer

(57) ABSTRACT

The invention is a combination of an actual person simulating the pitching motion and a pitching machine to throw the ball. A person when simulating pitching trips a switch and the ball is thrown by the pitching machine. The invention is a cylinder that fits within the inlet to the pitching machine. At the end of the cylinder is a ball stop which prevents the ball placed in the cylinder from entering the in pitching machine. A latch engages the spring loaded push bolt from pushing the ball out of the cylinder. A release arm extending from the latch is tripped allowing the push bolt to push the ball into the pitching machine by the operator during the release position of the wind up. In another embodiment the spring loaded push bolt is replaced with a solenoid and the release arm is replaced with an electric eye.

13 Claims, 6 Drawing Sheets

METHOD AND DEVICE FOR SIMULATING PITCHING

FIELD OF INVENTION

The invention relates to the field of the method of simulating of a pitcher's wind up and motion with a pitching machine and more particularly to the method of using an actual pitcher to simulate the motion of the pitcher but a pitching machine to throw the ball.

BACKGROUND OF INVENTION

Throwing batting practice is one of the most important aspects of preparing a baseball team. It is also the one that causes the biggest problems in that you need a pitcher or usually many pitchers to throw the balls to the players. This can wear out many players and coaches. Also, the pitcher for the batting practice must constantly throw the ball in the same place and at the same speed to get the hitters into their hitting rhythm. The pitcher must also know how to throw many different pitches to the hitters so the batters can work on their weaknesses. This usually cannot be done by the players on the team, especially players on high school and little league team who are not of professional caliber. A pitching machine can be used. Pitching machines are sophisticated enough to throw the ball at the same specific height and position over the plate. They can also throw curves and pitches at different speeds. This ideal for batting practice and does not wear out the players. Pitching machines, however, cannot simulate the pitching motion of an actual pitcher. Thus, one of the big objectives of this invention is to simulate an actual motion of a pitcher, however, not wear out that pitcher. Another objective is to simulate a pitcher and also be able to throw the ball at a given position and speed over the plate. Another objective is for the device to be able to throw both curve balls and throw at different speeds while simulating an actual pitcher's motion. There are machines that use large display systems and computerized pitching machines to simulate the pitcher's motion. However, these machines are very expensive. Thus, one of the objectives of this invention is to simulate a pitcher's motion by an inexpensive method. The feature that does this is that an actual pitcher simulates the pitching motion and when his arm comes forward, as in pitching, it trips a switch on a pitching machine that throws the ball.

The pitcher who simulates the motion does not spend nearly as much energy, both physically and mentally, to simulate pitching rather than actually throwing the ball. The simulation motion helps the batter tremendously. It is as if he is in an actual game where he sees the actual pitcher wind up and then throw.

SUMMARY OF THE INVENTION

The invention is a combination of an actual person simulating the pitching motion and a pitching machine to throw the ball. When the person simulating the pitching motion moves through the motion of throwing the ball, his arm trips a switch and the ball is thrown by the pitching machine. The device that allows the pitching machine to do this is comprised of cylinder that fits within the inlet to the pitching machine. At the end of the cylinder that attaches to the pitching machine there is a ball stop. This ball stop prevents a ball placed in the cylinder from entering the inlet to the pitching machine. In the preferred embodiment this ball stop selectively restricts the inside diameter of the cylinder and it prevents the ball from entering the pitching machine. The ball stop is made of a flexible, compressible material that prevents forward movement of the ball unless substantial force is applied. A spring loaded push bolt is slidably located through the cylinder. The push bolt has a first end and a second end. The first end of the push bolt is connected to a handle. The handle is manually grasped by the operator and pulled back to latch. The latch engages the handle and prevents the handle and the push bolt from immediately returning to the initial position. A release arm extends out from the latch. The operator can simulate a wind up and during the release position of the wind up contact the release arm. The release arm moves the latch thus allowing the push bolt the readily move in the cylinder. The second end of the push bolt contacts the ball pushing it over the ball stop and into the pitching machine and allowing the pitching machine to pitch the ball. Instead of release arm a solenoid can be used to move the latch and allow the push bolt to move within the cylinder. This solenoid can be triggered by an electric eye. Thus, when the pitcher moves his arm through the electric eye, the electric eye will trigger the solenoid which will release the latch on the push bolt allowing the push bolt to push the ball over the ball stop.

DETAILED DESCRIPTION OF THE PREFERRED EMBODIMENT

Figure 1:
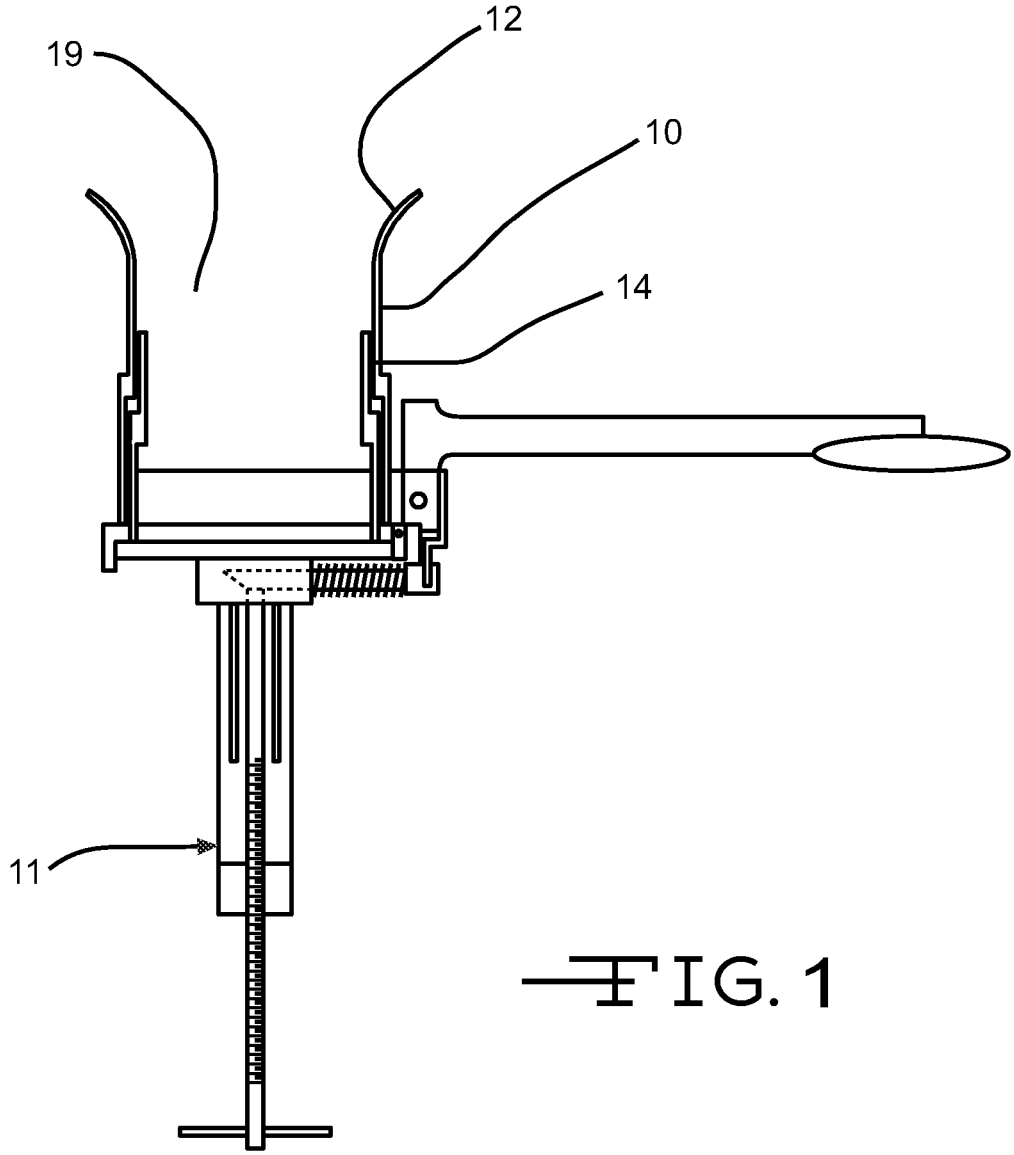
FIG. 1 is a cut away view of the invention without a ball.

FIG. 1 shows a cutaway view of the invention 11. FIG. 1 shows the cylinder 10 with its attachment end 12 that attaches to the inlet of the pitching machine. At the inlet end 19 of the cylinder 10 is the ball stop 14. In the preferred embodiment, the ball stop 14 is made out of a compressible, flexible material that prevents forward movement of the ball 16 as shown in FIG. 2.

Figure 2:
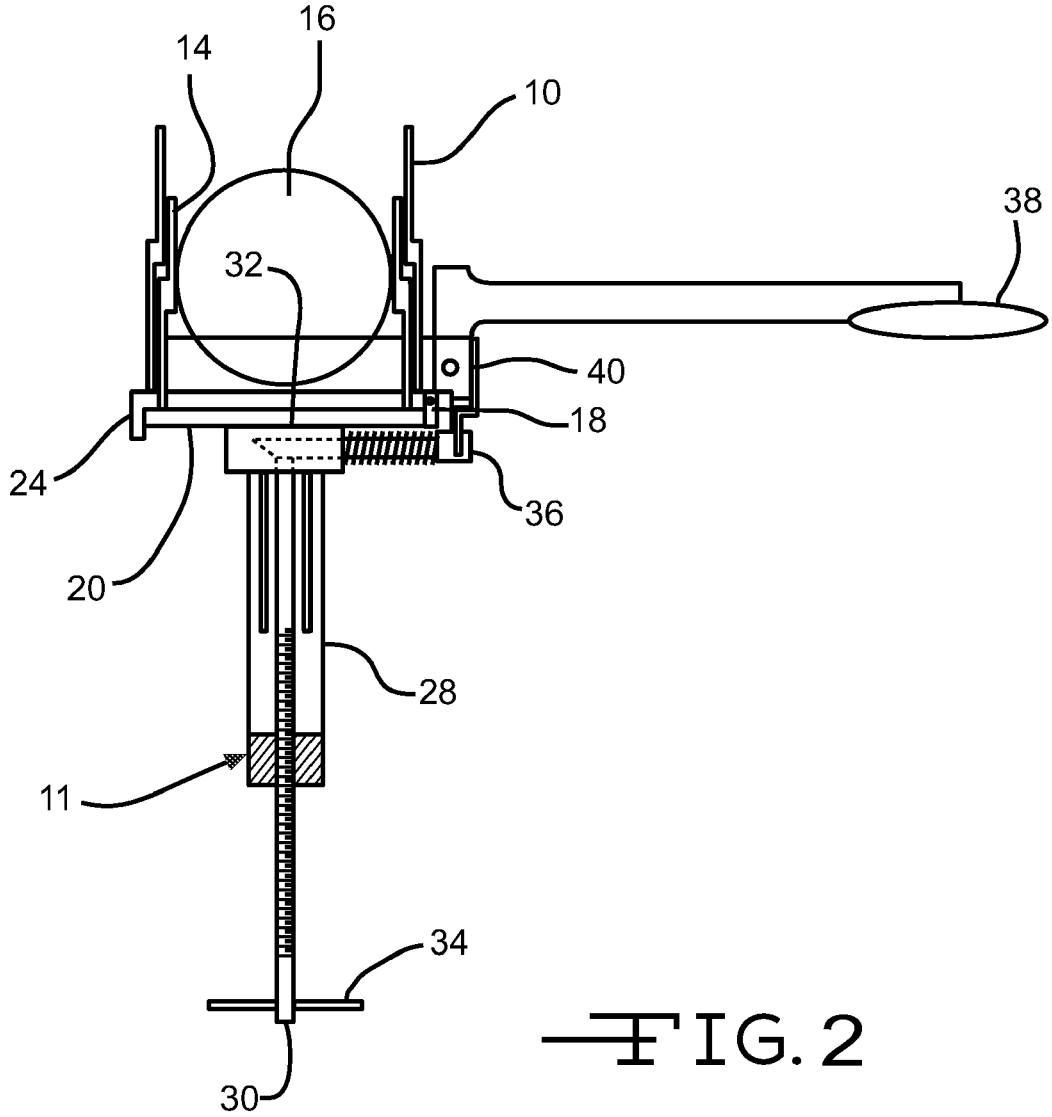
FIG. 2 is the same cut away view of the invention with a ball in place.

FIG. 2 is a cutaway view of one embodiment of the invention with a ball 16. On hinged end 18 of cylinder 10 is plate 20. Plate 20 is attached to the cylinder 10 by a hinge 22. Plate 20 can be further latched by latch 24 to the cylinder thus closing the hinge end 18 of cylinder 10. Thus, plate 20 can be opened or closed so that an individual can open plate 20 and place a ball within the cylinder 10 and then close plate 20 and latch it with latch 24. Plate 20 has an opening in approximately its middle. Through this opening is ran a spring loaded push bolt 28 with a first end 30 and a second end 32. On the first end 30 of the spring loaded push bolt 28 is located a handle 34. In this embodiment the handle 34 is manually grasped by the operator of the invention and pulled back. When the handle 34 is pulled back a pin 36 latches the handle in the back position as shown in FIGS. 1 and 2. Latch 36 engages the handle 34 and prevents the handle 34 and hence, the spring loaded push bolt 28 from immediately returning to its initial position. A release arm 38 is extends out radially from the spring loaded push bolt 28. Release arm 38 is attached to pin 36 by a releasing pivot 40. When release arm 38 moves forward, it moves release pivot 40 releasing pin 36 and allowing the spring loaded push bolt 28 to move forward into the unlatched position. The second end 32 of the spring loaded push bolt 28 contacts the ball 16 and pushes it over the ball stop 14 and into the pitching machine. The operator can simulate a wind up and during the release position of the wind up, contact with the release arm 38 thus releasing the ball 16 from the pitching machine and looking as if the pitcher had actually thrown the ball 16.

Figure 4:
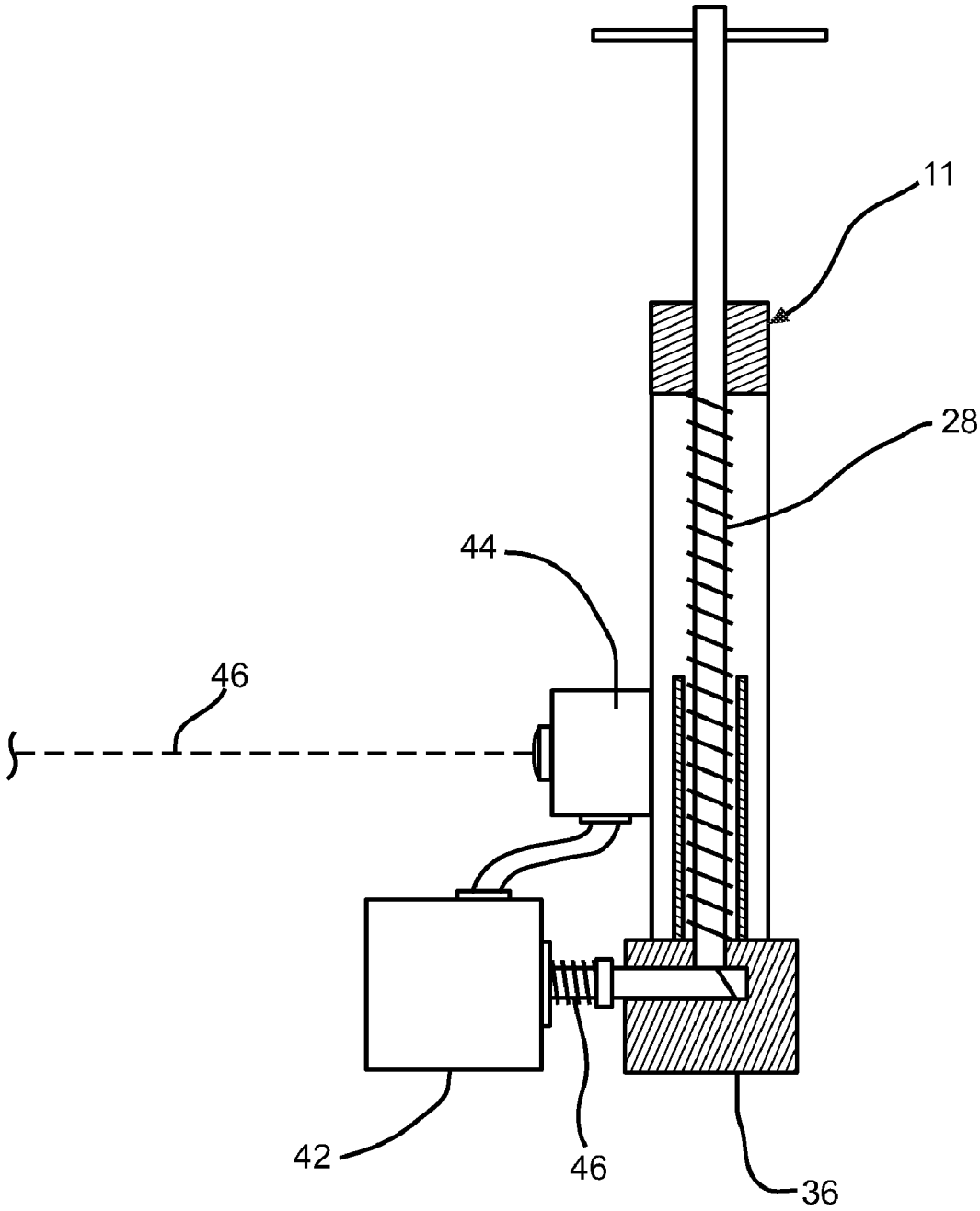
FIG. 4 is a cut away view of a third embodiment of the invention which has an electric eye and a solenoid.

FIG. 4 shows another embodiment of the spring loaded push bolt 28. In this embodiment the spring loaded push bolt 28 is exactly the same as the first embodiment, however, the release arm 38 and the release pin 40 have been replaced with a solenoid 42 and a photo electric eye 44. In place of the release pin 40 a solenoid 42 has been placed. Solenoid 42 has a plunger 46 that makes contact with the latch 36 and when plunger 46 moves forward, it releases latch 36 allowing the spring loaded push bolt 28 to move forward. The release arm is replaced by a photo electric eye 44. Within the photo eye 44 is electrical circuitry that when the light beam 46 is broken the electrical circuitry causes a electrical pulse to flow to the solenoid 42 causing the solenoid 42 to release the latch 36 and allow the spring loaded push bolt 28 to move forward. The spring loaded push bolt 28 pushes the baseball 16 as in the previous embodiment past the ball stop 14 and into the pitching machine. In this embodiment the operator can simulate a wind up and during the release position of the wind up, he moves his arm through the light beam 46 from the photo eye 44 thus breaking the light beam and causing the electrical circuitry in the photo eye 44 to cause the solenoid 42 to fire releasing the spring loaded push bolt 28 and thus, pitching the ball.

Figure 5:
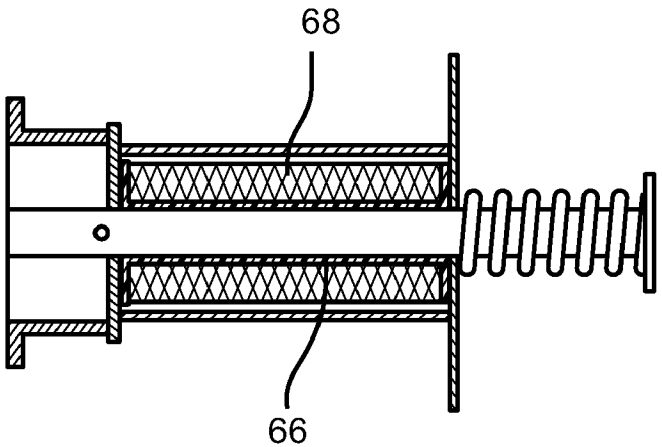
FIG. 5 is a view of the solenoid driven spring loaded push bolt.
Figure 3:
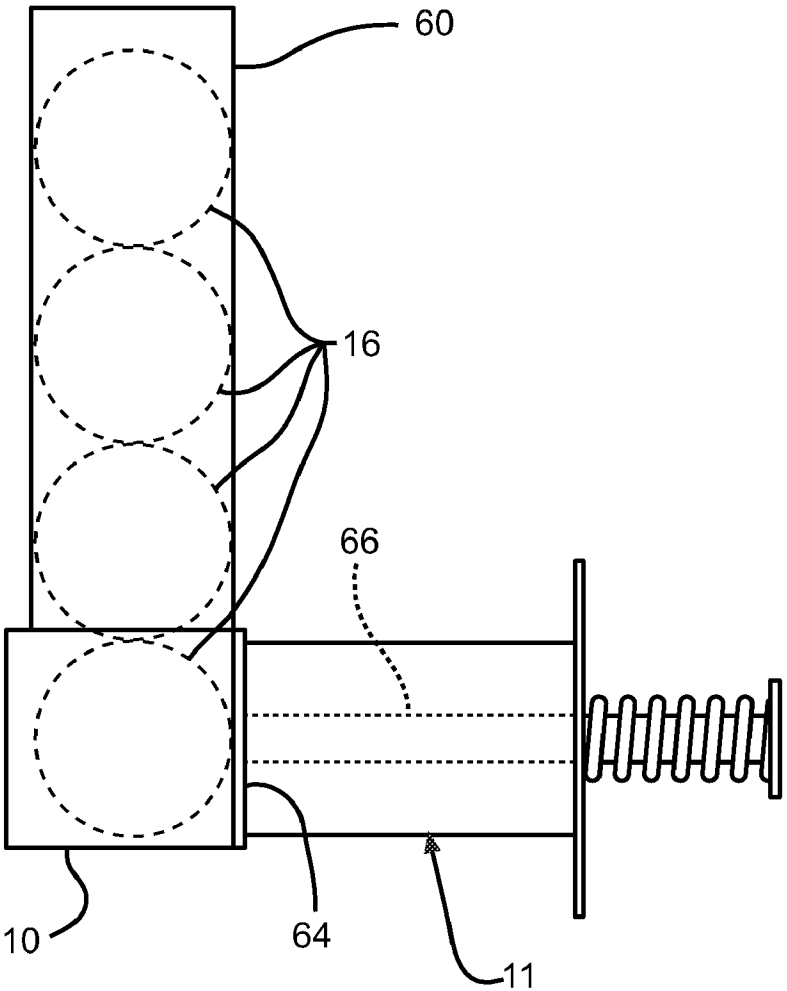
FIG. 3 is a cut away view of another embodiment of the invention where the balls are gravity fed.

FIG. 3 shows another embodiment of the invention. This embodiment is exactly the same as the previous embodiment except that the balls are not placed within the cylinder 10 by opening the hinged end 18 of the cylinder 10 but by dropping the balls 16 in by gravity feed. FIG. 3 is a cutaway side view of the invention. FIG. 3 shows a ball bin 60 in which the balls to be pitched by the pitching machine are placed. Ball bin 60 is attached at its end to cylinder 10. Balls in ball bin 60 drop into cylinder 10 by gravity. In this embodiment plate 64 is not hinged to the back of cylinder 10 but is permanently attached to cylinder 10. Ball Bin 60 is attached to the back of cylinder 10. As in the previous embodiment, plate 64 has an opening 26 through which a solenoid driven, spring loaded push bolt 66 is attached. Solenoid driven, spring loaded push bolt 66 shown in FIG. 5 is exactly the same as the spring loaded push bolt 28 in the previous embodiment except that this solenoid driven, spring loaded push bolt 66 is not manually drive, but solenoid driven. The solenoid driven spring loaded push bolt 66 is electrically pulls into latched position as shown in FIG. 5. Solenoid 68 attached to solenoid driven, spring loaded push bolt 66. A ball 16 from the ball bin falls into the cylinder 10.

Figure 6:
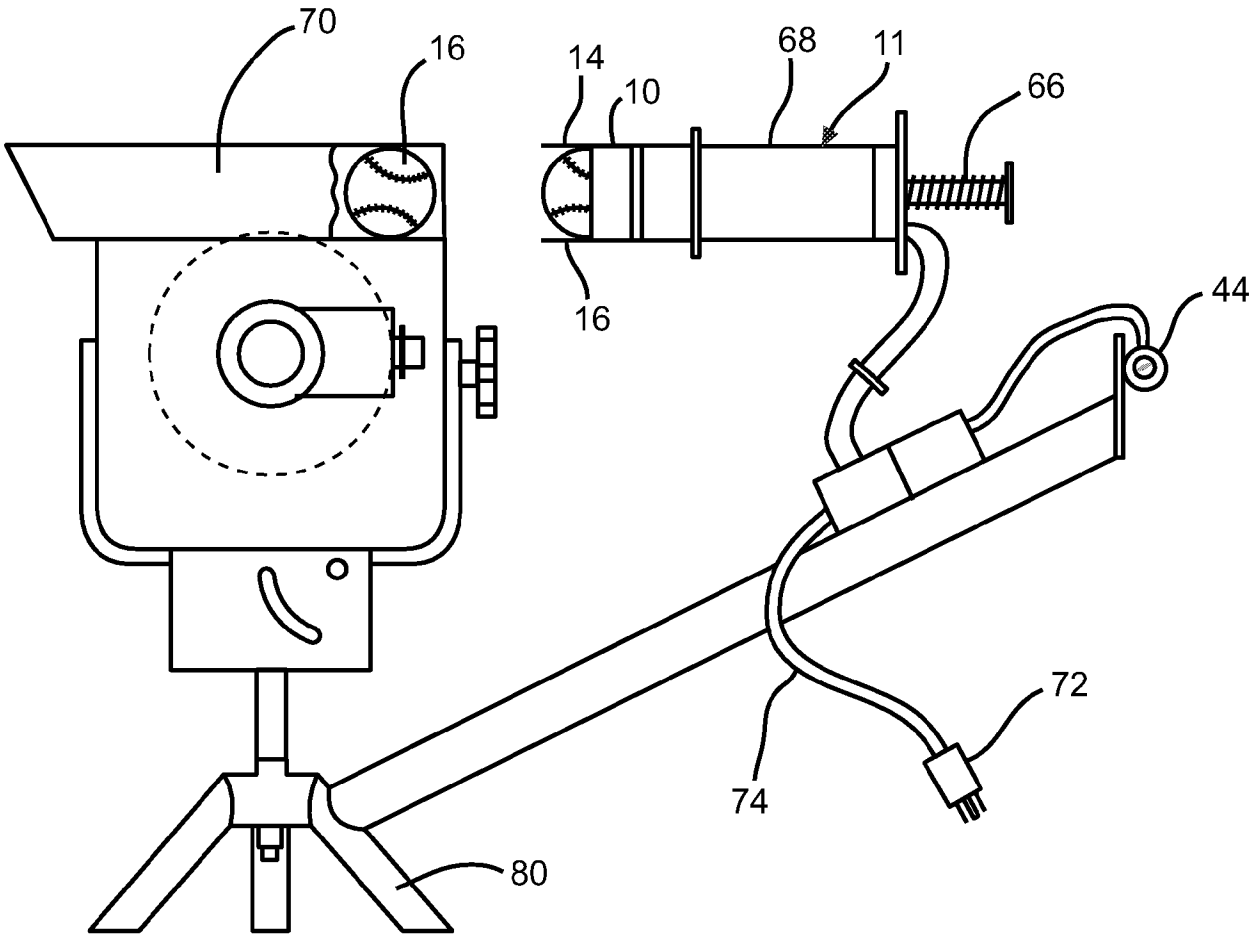
FIG. 6 is a side view of the invention attached to the tripod and pitching machine.
Figure 7:
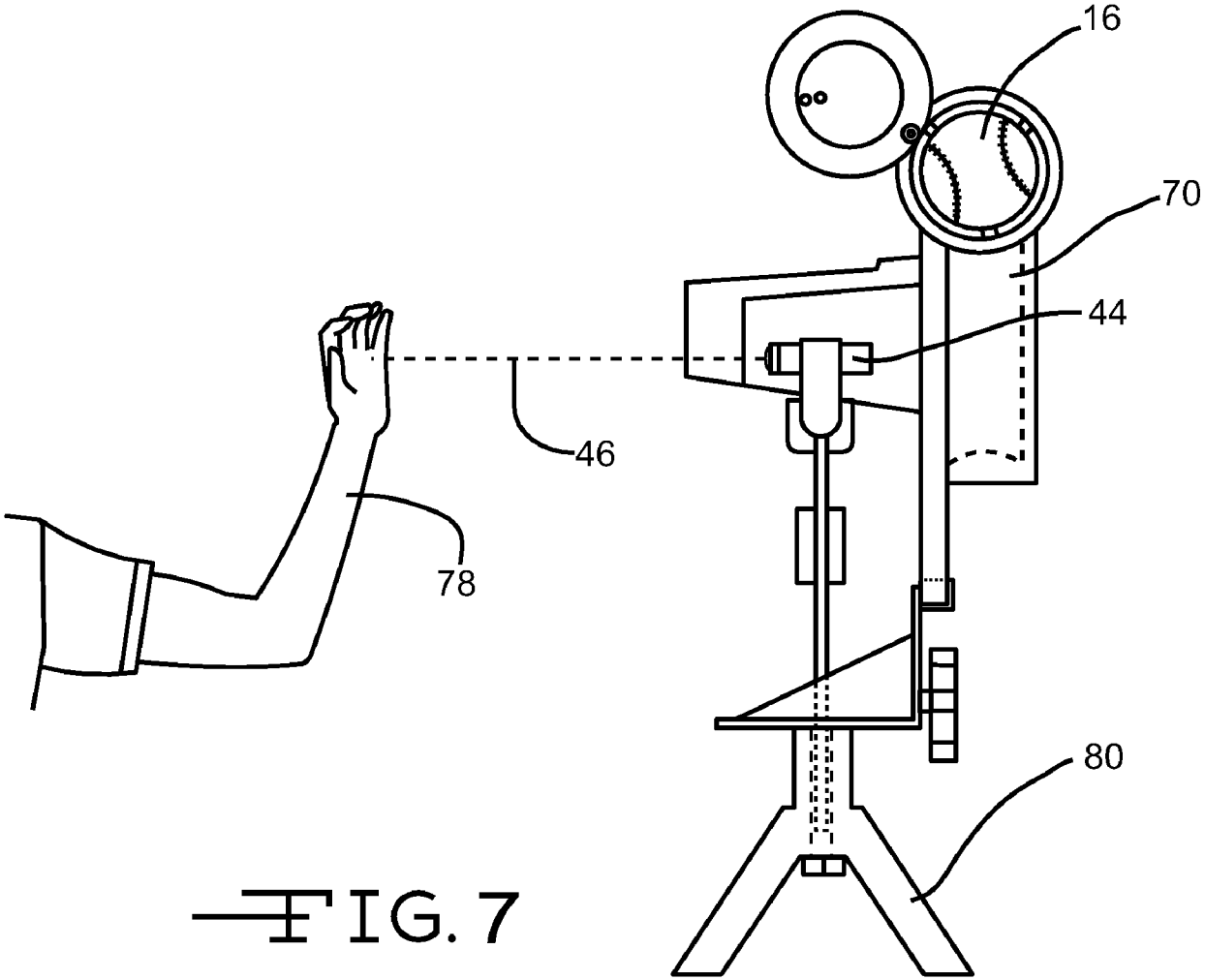
FIG. 7 is a front view of the invention showing how the pitching arm triggers the invention.

FIGS. 6 and 7 shows an embodiment to the invention containing all parts and using the solenoid driven push bolt 66 to push the ball into the pitching machine 70. One ball 16 has already been pushed into the pitching machine 70. In this embodiment, electric eye 44 sends its signal to the solenoid 68. When the light beam of electric eye 44 is broken, a signal from the electric eye 44 passes to solenoid 68 which releases solenoid driven the spring loaded push bolt 66 and pushing the ball past the ball stop 14 and into the pitching machine 70. The solenoid driven spring loaded push bolt 66 immediately returns to its latch position allowing another ball to be placed into cylinder 10. The solenoid driven spring loaded push bolt 66 is driven by electric that come from a receptacle through plug 72 and wirer 74

FIG. 7 shows a set up of the invention. The pitching machine 70, electric eye 44, and all set on a leg tripod assembly 80. As in the previous embodiment, the operator can simulate a wind up and in the release position of the wind up his arm 78 trips the light beam 46, thus breaking the light beam and causing the signal from the electric eye 44 to be sent to the solenoid 68 to release the solenoid driven, spring loaded push bolt 66 to push the ball 16 into the pitching machine 70 and thus it looks like the individual has actually released the ball.

The invention claimed is:

1. A method for simulated pitching with a pitching machine comprising:

a. simulating a pitching motion by a person who moves in a motion of throwing a ball; and b. tripping a mechanical switch with a wing by the person's arm moving forward simulating the pitching motion and said arm as it moves forward hits the wing; and, c. mechanically loading a ball in a pitching machine by a device that loads the ball when the switch is tripped; and, d. ejecting the ball by the pitching machine and said pitching machine has been placed in a position that the ball that has been ejected by the pitching machine looks like its has been thrown by the person.

2. A method for simulated pitching with a pitching machine comprising:

a. simulating a pitching motion by a person who moves in a motion of throwing a ball; and b. tripping a switch that is a photoelectric cell as the person's arm moves forward simulating the pitching motion, the arm passes the photoelectric cell causing the photoelectric cell to send a signal to the device that loads the ball in the pitching machine signaling the device to load the ball into the pitching machine; and, c. loading a ball in a pitching machine by a device that loads the ball when the photoelectric cell to send a signal; and, d. ejecting the ball by the pitching machine and said pitching machine has been placed in a position that the ball that has been ejected by the pitching machine looks like its has been thrown by the person.

3. A method for simulated pitching with a pitching machine comprising:

a. simulating a pitching motion by a person who moves in a motion of throwing the ball; and, b. tripping a switch as the person's arm moves forward simulating the pitching motion; and, c. loading a ball in a pitching machine by a device comprising:

(1). a cylinder with an end that can be selectively closed or opened to allow a ball to be place within the cylinder and an open end that fits within the inlet to the pitching machine: and, (2). a ball stop at the open end of the cylinder that fits within the pitching machine that selectively restricts the inside diameter of the cylinder and prevents a ball placed in the open end of the cylinder from entering the patching machine;

(3). a mechanism that fits on the end of the cylinder that can be selectively closed or opened and said mechanism can be latch such that when unlatched said mechanism will push the ball placed within the cylinder past the ball stop and into the pitching machine; and, (4). the mechanism is unlatched by the tripping of the switch d. Ejecting a ball by the pitching machine and said pitching machine has been placed in a position that the ball that has been ejected by the pitching machine looks like it has been thrown by the person.

4. A method for simulated pitching with a pitching machine as in claim 3 further comprising:

a. opening the end of the cylinder; and, b. placing a ball into the cylinder; and, c. closing the cylinder; and, d. latching the mechanism; and, e. when the switch is tripped the mechanism unlatches and the ball is loaded into the pitching machine.

5. A method for simulated pitching with a pitching machine as in claim 4 wherein:

a. the mechanism is a spring loaded push bolt that is located in the cylinder and when the spring loaded push bolt is unlatched the bolt will push a ball place in the cylinder past the ball stop and load the ball into the pitching machine.

6. A method for simulated pitching with a pitching machine as in claim 5 wherein:

a. the switch is a mechanical switch with a wing that when the person, who moves his arm forward as if to throw, hits the wing which mechanically cause the spring load push bolt to push the ball into the pitching machine.

7. A method for simulated pitching with a pitching machine as in claim 4 wherein:

a. the mechanism is a solenoid with a bolt that is located in the cylinder, said solenoid is design such that its bolt can be in a latched or unlatched and in unlatched position will push a ball that has been placed into the cylinder past the ball stop and into the pitching machine.

8. A method for simulated pitching with a pitching machine as in claim 7 wherein:

a. the switch is a photo electric cell that when the person's arm move forward as if to throw, the arm passes the photoelectric cell causing the photoelectric cell to send a signal to the solenoid signaling the solenoid to push the ball into the pitching machine.

9. An apparatus for placing a ball in a pitching machine when a person who is simulating pitching moves his arm forward as if to throw a ball comprising:

a. a switch that is tripped by the person arm moving forward as if to pitch; and, b. a cylinder with an end that can be selectively closed or opened to allow a ball to be place within the cylinder and an open end that fits within the inlet to the pitching machine: and, c. a ball stop at the open end of the cylinder that fits within the pitching machine that selectively restricts the inside diameter of the cylinder and prevents a ball placed in the open end of the cylinder from entering the patching machine;

d. a mechanism that fits on the end of the cylinder that can be selectively closed or opened and said mechanism can be latch such that when unlatched said mechanism will push the ball placed within the cylinder past the ball stop and into the pitching machine; and, e. the mechanism is unlatched by the tripping of the switch.

10. An apparatus for placing a ball in a pitching machine when a person who is simulating pitching moves his arm forward as it to throw a ball as in claim 9 wherein:

a. the switch is a mechanical switch with a wing that when the person moves his arm forward as if to throw the arm hits the wing which mechanically cause the mechanism to unlatch.

11. An apparatus for placing a ball in a pitching machine when a person who is simulating pitching moves his arm forward as it to throw a ball as in claim 10 wherein:

a. the mechanism is a spring loaded push bolt that is located in the cylinder and when the spring loaded push bolt is unlatched the spring loaded push bolt will push a ball place in the cylinder past the ball stop and load it into the pitching machine.

12. An apparatus for placing a ball in a pitching machine when a person who is simulating pitching moves his arm forward as it to throw a ball as in claim 9 wherein:

a. the switch is a photo electric cell that when the person's arm move forward as if to throw, the arm passes the photoelectric cell causing the photoelectric cell to send a signal to the mechanism and causes the mechanism to unlatch.

13. An apparatus for placing a ball in a pitching machine when a person who is simulating pitching moves his arm forward as it to throw a ball as in claim 12 wherein:

a. the mechanism is a solenoid with a bolt that is located in the cylinder, said solenoid is design such that its bolt can be in a latched or unlatched position and in the unlatched position the bolt will push a ball that has been placed into the cylinder past the ball stop and load the ball into the pitching machine.

* * * * *